US011567436B2

(12) United States Patent
Chikugo et al.

(10) Patent No.: US 11,567,436 B2
(45) Date of Patent: Jan. 31, 2023

(54) IMAGE HEATING APPARATUS AND IMAGE FORMING APPARATUS

(71) Applicant: Canon Kabushiki Kaisha, Tokyo (JP)

(72) Inventors: Youichi Chikugo, Chiba (JP); Rikiya Takemasa, Chiba (JP); Hidekazu Tatezawa, Saitama (JP); Takeshi Kozuma, Tokyo (JP); Yutaro Tsuno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/240,015

(22) Filed: Apr. 26, 2021

(65) Prior Publication Data

US 2021/0356888 A1 Nov. 18, 2021

(30) Foreign Application Priority Data

May 12, 2020 (JP) ..... JP2020-083700

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2032; G03G 15/2035; G03G 15/2053; G03G 2215/2003; G03G 21/1685; G03G 2221/1639
See application file for complete search history.

(56) References Cited

U.S. PATENT DOCUMENTS

| | | | |
|---|---|---|---|
| 8,165,500 | B2 | 4/2012 | Kamiya et al. |
| 10,859,953 | B2 | 12/2020 | Fukamachi et al. |
| 2011/0135341 | A1 | 6/2011 | Kamiya et al. |
| 2020/0233354 | A1 | 7/2020 | Tatezawa et al. |

FOREIGN PATENT DOCUMENTS

| | | | |
|---|---|---|---|
| JP | 2009271178 A | * | 11/2009 |
| JP | 2011-123181 A | | 6/2011 |
| JP | 2020118812 A | | 8/2020 |

* cited by examiner

*Primary Examiner* — Thomas S Giampaolo, II
(74) *Attorney, Agent, or Firm* — Venable LLP

(57) ABSTRACT

An image heating apparatus includes a first rotary member, a second rotary member, a frame member, a guide portion, and a cover. The first rotary member is configured to heat a toner image formed on a recording material. The second rotary member is configured to contact the first rotary member and form a fixing nip portion with the first rotary member. The frame member is configured to support the first rotary member and the second rotary member. The guide portion is configured to guide the first rotary member to be moved upstream in a conveyance direction of the recording material when the first rotary member is being removed. The cover is attached to the frame member and configured to turn around a rotation shaft to open and close the guide portion. The cover is configured to turn in a direction toward the conveyance direction to open the guide portion.

14 Claims, 9 Drawing Sheets

IMAGE HEATING APPARATUS AND IMAGE FORMING APPARATUS

BACKGROUND OF THE INVENTION

Field of the Invention

The present invention relates to an image heating apparatus for fixing a toner image transferred onto a recording material in an image forming apparatus that adopts an electrophotographic system or an electrostatic recording system, and the image forming apparatus.

Description of the Related Art

Hitherto, in an image forming apparatus adopting an electrophotographic system, an electrostatic latent image formed on a photosensitive drum serving as an image bearing member is developed using toner to form a toner image and the toner image is transferred to a recording material before the toner image is fixed to the recording material in a fixing unit, which is one example of an image heating apparatus. One example of a fixing unit used widely is a heat-pressure type unit that includes a heating rotary member and a pressing rotary member that applies pressure to the heating rotary member, wherein a fixing nip portion formed between the heating rotary member and the pressing rotary member nips and conveys the recording material, by which the toner borne on the recording material is fixed thereto by heat and pressure.

Processing speed of electrophotographic image forming apparatuses is increasing, and in response thereto, the size of the heating rotary member in the fixing unit is increased. Therefore, a fixing unit has been developed in which the heating rotary member stretched across a fixing roller and a heating roller is formed of a thin belt member (refer to Japanese Patent Application Laid-Open Publication No. 2011-123181). According to the fixing unit disclosed in Japanese Patent Application Laid-Open Publication No. 2011-123181, for example, a heating unit including the heating rotary member can be replaced with respect to a frame member such as a casing of the fixing unit to facilitate maintenance and extend service life of the heating rotary member forming the fixing nip portion.

However, according to the fixing unit disclosed in the above-mentioned Japanese Patent Application Laid-Open Publication No. 2011-123181, a cover of the frame member provided in the fixing unit is designed to open to a direction toward which the heating unit is removed. Therefore, when removing the heating unit from the frame member for replacement, the opened cover may be in the way of with the heating unit and hinder the replacement operation of the heating unit.

The present invention provides an image heating apparatus and an image forming apparatus that enables to improve workability of attaching and detaching the heating unit to and from the frame member.

SUMMARY OF THE INVENTION

According to a first aspect of the present invention, an image heating apparatus includes a first rotary member configured to heat a toner image formed on a recording material, a second rotary member configured to contact the first rotary member and form a fixing nip portion with the first rotary member for conveying the recording material, a frame member configured to support the first rotary member and the second rotary member, a guide portion configured to guide the first rotary member to be moved upstream in a conveyance direction of the recording material when the first rotary member is being removed, and a cover attached to the frame member and configured to turn around a rotation shaft to open and close the guide portion. The cover is configured to turn in a direction toward the conveyance direction to open the guide portion.

According to a second aspect of the present invention, an image forming apparatus configured to form an image on a recording material includes the image heating apparatus, and a drawer portion configured to support the image heating apparatus and be drawn out from the image forming apparatus.

Further features of the present invention will become apparent from the following description of exemplary embodiments with reference to the attached drawings.

DESCRIPTION OF THE EMBODIMENTS

An embodiment of the present invention will be described in detail with reference to FIGS. 1 to 9. In the present embodiment, a tandem-type full color printer is illustrated as an example of an image forming apparatus 1. However, the present technique is not limited to application to tandem-type image forming apparatuses 1, and it can be applied to other types of image forming apparatuses. Further, the printer is not limited to full-color printers, and it can be monochrome or mono-color printers.

Image Forming Apparatus

Figure 1:
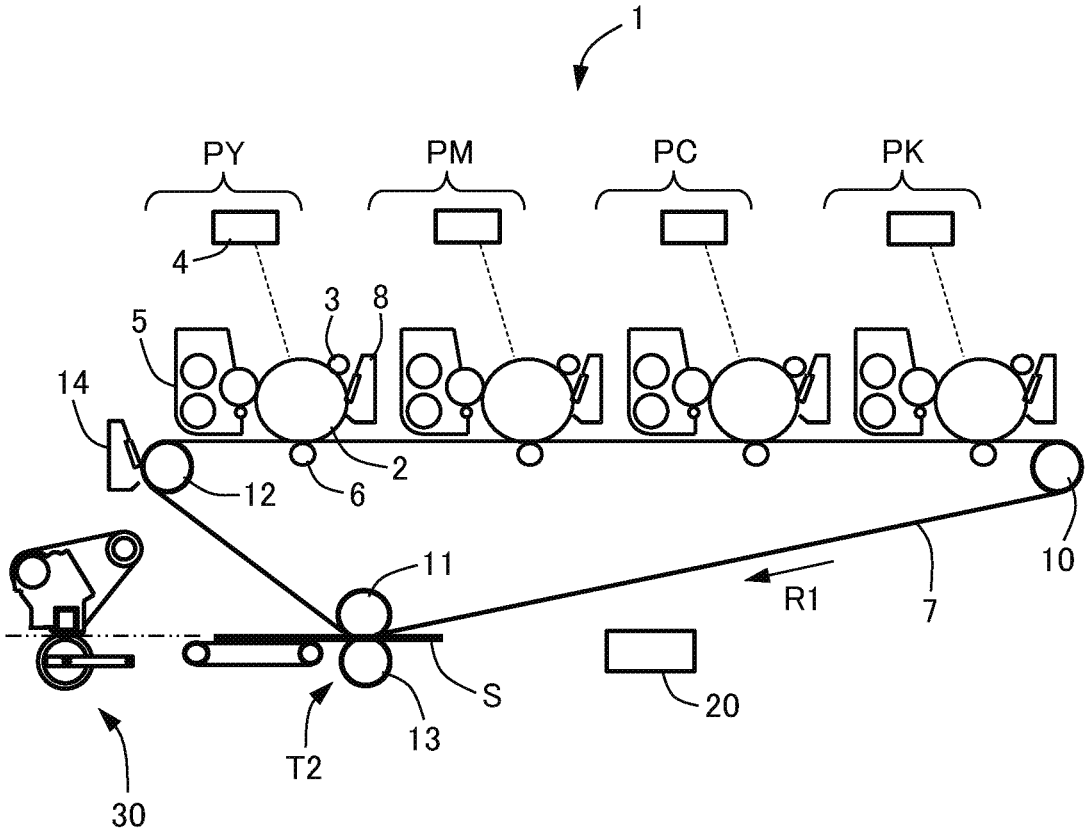
FIG. 1 is a cross-sectional view illustrating a general configuration of an image forming apparatus according to an embodiment.

As illustrated in FIG. 1, the image forming apparatus 1 is a full color printer that adopts an electrophotographic system in which four image forming units PY, PM, PC, and PK of yellow, magenta, cyan and black are provided in an apparatus body. The present embodiment adopts a tandem intermediate-transfer system in which the image forming units PY, PM, PC, and PK are arranged along a direction of rotation of an intermediate transfer belt 7 described later. The image forming apparatus 1 forms a toner image on a recording material S according to an image signal from a document reader not shown connected to the apparatus body or a host device such as a personal computer connected to and communicating with the apparatus body. Sheet materials such as paper, plastic film and cloth are examples of the recording material S. Further, the image forming apparatus 1 includes a control unit 20 for performing various controls such as an image forming process.

An image forming process will be described. At first, the image forming units PY, PM, PC, and PK will be described. In the present embodiment, the image forming units PY, PM, PC, and PK adopt approximately the same configuration except for the differences in toner colors, which are yellow, magenta, cyan, and black. The image forming unit PY of yellow toner will be described hereafter as an example, and descriptions of other image forming units PM, PC, and PK are omitted.

The image forming unit PY is mainly composed of a photosensitive drum 2, a charging apparatus 3, an exposing unit 4, and a developing apparatus 5. A surface of the photosensitive drum 2 serving as an example of an image bearing member being driven to rotate is uniformly charged in advance by the charging apparatus 3, and thereafter, an electrostatic latent image is formed thereon by the exposing unit 4 driven based on an image information signal. That is, an electrostatic latent image is formed on the photosensitive drum 2. The electrostatic latent image formed on the photosensitive drum 2 is developed by toner in the developing apparatus 5 and visualized as toner image. Toner in the developer consumed by image formation is replenished together with carrier from a toner cartridge not shown.

Thereafter, a predetermined pressurizing force and primary transfer bias are applied by a primary transfer roller 6 arranged opposed to the photosensitive drum 2 interposing the intermediate transfer belt 7, and the toner image formed on the photosensitive drum 2 is primarily transferred to the intermediate transfer belt 7. Transfer residual toner remaining slightly on the photosensitive drum 2 after primary transfer is removed by a cleaning device 8 to prepare the photosensitive drum 2 for a subsequent image forming process.

The intermediate transfer belt 7 is stretched across a tension roller 10, a secondary transfer inner roller 11 and a drive roller 12. The intermediate transfer belt 7 is driven to move in a direction of arrow R1 in the drawing by the drive roller 12. Image forming processes of respective colors performed by the above-mentioned image forming units PY, PM, PC, and PK are carried out at timings set so that toner images are sequentially superposed to a toner image previously formed upstream in the direction of movement on the intermediate transfer belt 7 via primary transfer. As a result, a full-color toner image is finally formed on the intermediate transfer belt 7 and conveyed to a secondary transfer portion T2. The secondary transfer portion T2 is a transfer nip portion formed between the intermediate transfer belt 7 stretched on the secondary transfer inner roller 11 and a secondary transfer outer roller 13. Transfer residual toner that remains after passing through the secondary transfer portion T2 is removed from the intermediate transfer belt 7 by a transfer cleaner device 14.

A conveyance process of the recording material S to the secondary transfer portion T2 is performed at a similar timing as a forming process of toner image that has been conveyed to the secondary transfer portion T2. In the conveyance process, the recording material S is fed from a sheet cassette and the like not shown and sent to the secondary transfer portion T2 at a matched timing with the forming of image. At the secondary transfer portion T2, secondary transfer voltage is applied to the secondary transfer inner roller 11.

As described, toner image is secondarily transferred from the intermediate transfer belt 7 to the recording material S at the secondary transfer portion T2 by the image forming process and the conveyance process. Thereafter, the recording material S is conveyed to a fixing unit 30 and subjected to heat and pressure by the fixing unit 30, according to which the toner image is melted and fixed to the recording material S. The fixing unit 30 is an example of the image heating apparatus for fixing an unfixed toner image formed by the image forming unit to the recording material S. The recording material S to which toner image has been fixed is discharged to a sheet discharge tray not shown by a sheet discharge roller.

Control Unit

The image forming apparatus 1 includes the control unit 20 for performing various controls such as the image forming operation described above. The operations of various units of the image forming apparatus 1 are controlled by the control unit 20 provided in the image forming apparatus 1. The series of image forming operations are controlled by the control unit 20 based on various input signals entered through an operation portion provided on an upper side of the apparatus body or via a network.

Figure 2:
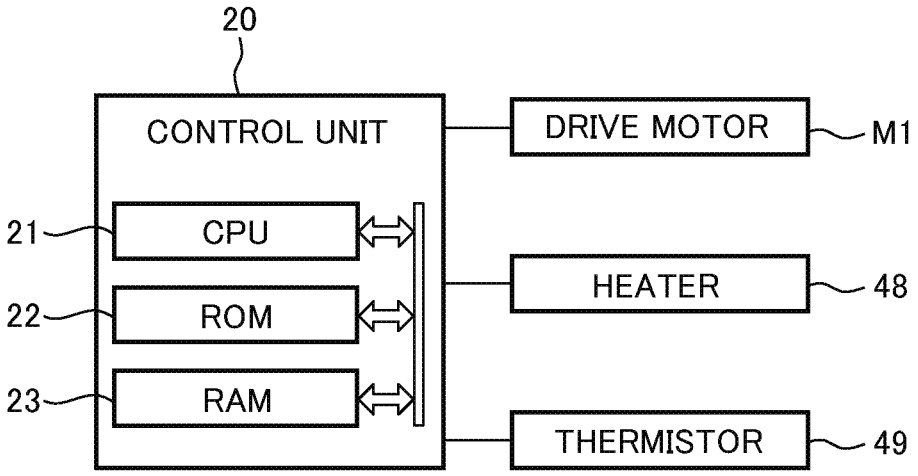
FIG. 2 is a control block diagram of the image forming apparatus according to the embodiment.

As illustrated in FIG. 2, the control unit 20 includes a CPU (Central Processing Unit) 21 serving as an arithmetic control unit, a ROM (Read Only Memory) 22, a RAM (Random Access Memory) 23 and so on. The CPU 21 reads programs corresponding to control procedures stored in the ROM 22 to carry out control of various units of the image forming apparatus 1. The RAM 23 stores working data and input data, and the CPU 21 refers to the data stored in the RAM 23 based, for example, on the program mentioned earlier to perform control. A drive motor M1 for driving a fixing belt 41 and a pressure roller 32 of the fixing unit 30 described later, a heater 48 and a thermistor 49 described later are connected to the control unit 20.

Fixing Unit

Figure 3:
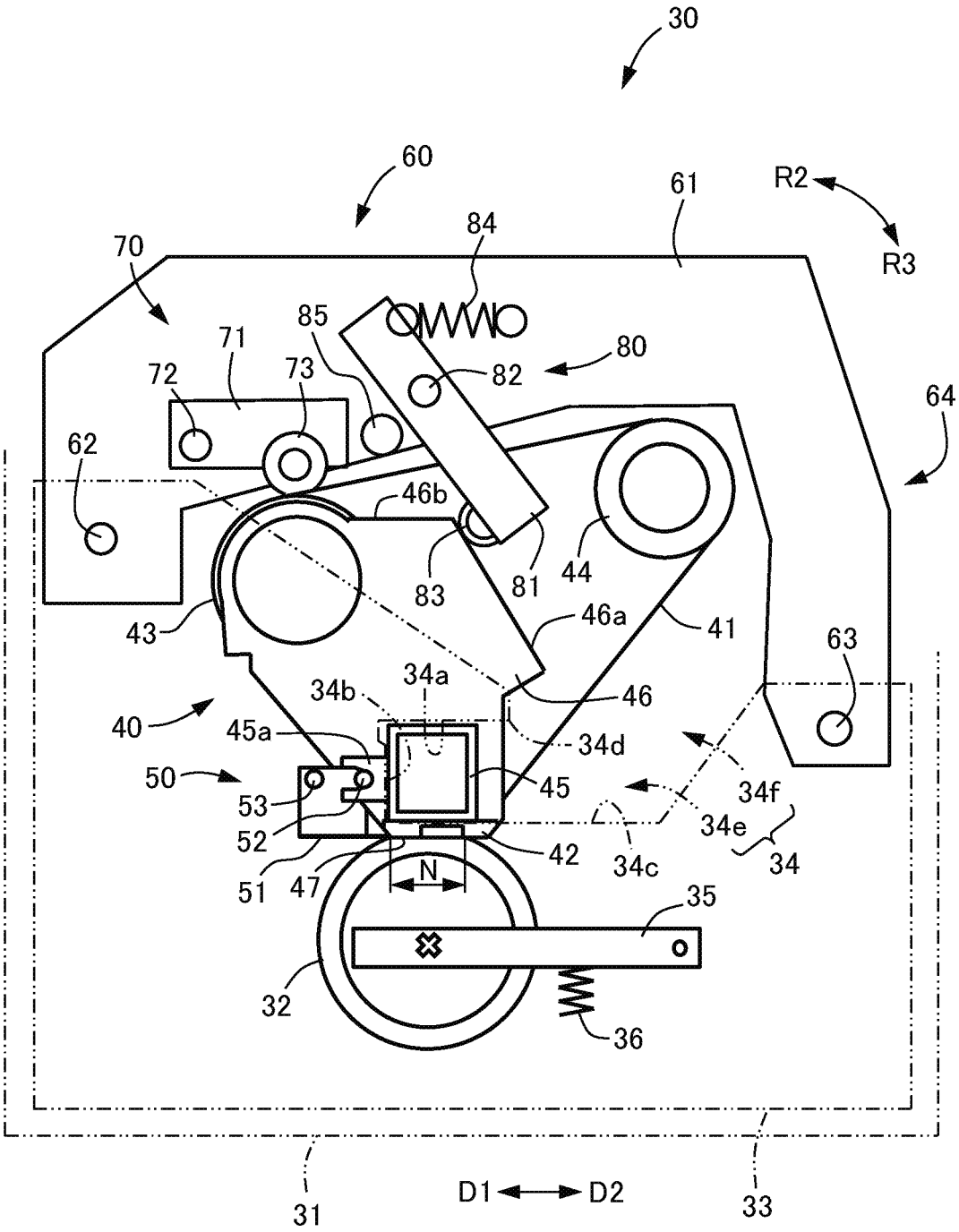
FIG. 3 is a cross-sectional view illustrating a state in which a heating unit is positioned at an attachment position and a cover is closed to form a fixing nip portion in a fixing unit according to the embodiment.

Next, the fixing unit 30 will be described in detail with reference to FIG. 3. As illustrated in FIG. 3, the fixing unit 30 is a belt heating-type heating apparatus that is in the form of a cartridge being detachably attached to the apparatus body of the image forming apparatus 1 (refer to FIG. 1). The fixing unit 30 includes a casing 31, which is an example of a frame member, a heating unit 40, a pressure roller 32 serving as a second rotary member, a separation unit 50 and a cover 60. The casing 31 according to the present embodiment is formed by welding together a plurality of metal plates. However, the metal plates can be fixed by methods other than welding, such as by screw engagement.

Figure 9:
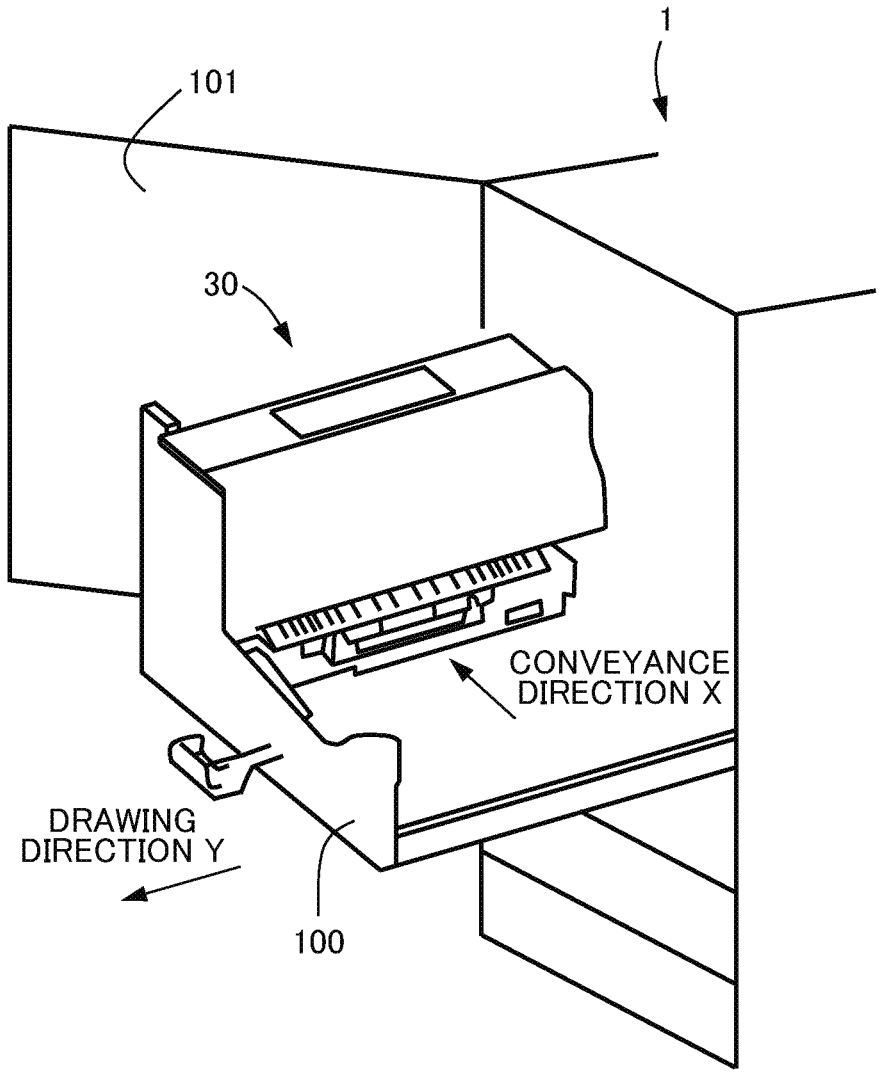
FIG. 9 is a perspective view illustrating a state in which the fixing unit is drawn out of the image forming apparatus in the fixing unit according to the embodiment.

Meanwhile, according to the present embodiment, the fixing unit 30 is supported by a drawer portion 100 that can be drawn out of the image forming apparatus 1, as illustrated in FIG. 9. In a state where a cover 101 of the image forming apparatus 1 is opened and the drawer portion 100 is drawn out to a drawing direction Y, the fixing unit 30 can be accessed. In the present embodiment, the drawing direction Y is a horizontal direction that is orthogonal to a conveyance direction X, i.e., sheet conveyance direction, of the recording material.

The heating unit 40 includes the fixing belt 41 serving as a first rotary member that is a rotatable endless belt, a pressure pad 42 serving as a fixing member, a heating roller 43, a steering roller 44, a stay 45, and unit side plates 46 that integrate these members as a cartridge. The heating unit 40 is attached in a detachable manner to the casing 31.

The fixing belt 41 is a thin, cylindrical belt member having thermal conductivity and heat resisting property, and can abut against and heat the recording material S. In the present embodiment, the fixing belt 41 adopts a three-layer structure including a base layer, an elastic layer formed on a circumference of the base layer, and a releasing layer formed on a circumference of the elastic layer. The base layer is formed of polyimide resin (PI) and has a thickness of 30 μm, and the elastic layer is formed of silicone rubber and has a thickness of 300 μm. The releasing layer is formed of PFA (tetrafluoro-ethylene-perfluoro alkoxy ethylene copolymer resin) as fluororesin and has a thickness of 30 μm. The fixing belt 41 is stretched across the pressure pad 42, the heating roller 43 and the steering roller 44. An outer diameter of the fixing belt 41 is, for example, 120 mm.

The pressure pad 42 is supported by the stay 45 and pressed by the pressure roller 32 interposing the fixing belt 41. The stay 45 is formed of stainless steel, and both ends in the rotational axis direction of the stay 45 are supported by fixing frames 33 of the casing 31 of the fixing unit 30. The stay 45 includes a separation plate positioning portion 45*a*. A fixing nip portion N is formed by a contact portion of the fixing belt 41 and the pressure roller 32. The rotational axis direction refers to a direction orthogonal to a sheet conveyance direction X of the recording material S that had passed through the fixing nip portion N.

The pressure pad 42 is formed, for example, of LCP (liquid crystal polymer) resin. A lubricating sheet 47 is interposed between the pressure pad 42 and the fixing belt 41. A PI (polyimide) sheet being coated with PTFE (polytetrafluoroethylene) with a thickness of 100 μm is used as the lubricating sheet 47. The PI sheet has 100-μm projections formed at 1-mm intervals to reduce a contact area with the fixing belt 41, to thereby reduce sliding resistance. A lubricant is applied to an inner side of the fixing belt 41 so that the fixing belt 41 slides smoothly on the pressure pad 42. The lubricant can be, for example, a silicone oil.

The heating roller 43 is a stainless-steel pipe with a thickness of 1 mm and having the heater 48 (refer to FIG. 2) formed of a halogen heater arranged in the interior of the heating roller 43 to heat the roller to a predetermined temperature. The fixing belt 41 is heated by the heating roller 43 and controlled to a predetermined target temperature set according to sheet types based on temperature detected by the thermistor 49 (refer to FIG. 2). Further, the heating roller 43 has a gear not shown fixed to a first end thereof in the rotational axis direction, and the heating roller 43 is connected via the gear to the drive motor M1 (refer to FIG. 2) that drives the heating roller 43 to rotate. The fixing belt 41 is driven to rotate following the rotation of the heating roller 43.

The steering roller 44 has a pivot axis that is arranged approximately in a vertical direction at a first end or near a center portion in the rotational axis direction, and pivots with respect to the fixing belt 41 to create a tension difference in the main scanning direction and adjust the position of the fixing belt 41 in the main scanning direction. Further, the steering roller 44 is urged by a spring not shown supported by a frame of the heating unit 40 and serves as a tension roller for applying predetermined tension to the fixing belt 41.

The pressure roller 32 is opposed to and abuts against the fixing belt 41, forming the fixing nip portion N where pressure is applied between the pressure roller 32 and the fixing belt 41. The pressure roller 32 is a roller in which an elastic layer is formed on a circumference of a shaft and a releasing layer is formed on a circumference of the elastic layer. In the pressure roller 32, the shaft is formed of stainless steel, and the elastic layer is formed of conductive silicon rubber having a thickness of 3 mm. The releasing layer is formed of PFA (tetrafluoro-ethylene-perfluoro alkoxy ethylene copolymer resin) as fluororesin having a thickness of 30 μm. The pressure roller 32 is axially supported by the fixing frames 33 on the casing 31 of the fixing unit 30, and a gear is fixed to a first end of the pressure roller 32 in the rotational axis direction, wherein the pressure roller is connected through the gear to the drive motor M1 (refer to FIG. 2) and rotated.

The recording material S (refer to FIG. 1) bearing a toner image is nipped by the fixing nip portion N formed between the fixing belt 41 and the pressure roller 32, and the toner image is heated while the recording material is being conveyed. As described, the fixing unit 30 nips and conveys the recording material S while fixing the toner image to the recording material S. Therefore, the fixing unit 30 must realize both a function to apply heat and pressure and a function to convey the recording material S.

The separation unit 50 is provided on the fixing frames 33 and includes a separation plate 51, and a guide shaft 52 and a rotation shaft 53 which are protruded toward either side in the rotational axis direction. The separation unit 50 is axially supported in a swingable manner by the rotation shaft 53 on the fixing frames 33. The separation plate 51 is provided to separate the recording material S having passed through the fixing nip portion N from the fixing belt 41, and it is formed by adhering a fluorine-based tape on a metal plate to prevent adhesion of toner and damaging of image on the recording material S by slide movement. The guide shaft 52 is arranged upstream in the sheet conveyance direction (direction D1 in the drawing) X of the rotation shaft 53.

The fixing frames 33 are arranged in a fixed manner on both side portions of the casing 31 with respect to the rotational axis direction, and each fixing frame 33 is provided with a guide portion 34, a pressing frame 35 and a pressurizing spring 36. The stay 45 of the heating unit 40 is inserted to the guide portion 34, pressed against and fixed to the guide portion 34 by a pressing portion 80 described later. After fixing the stay 45 to the guide portion 34, the pressing frame 35 is moved toward the heating unit 40 by a drive source and a cam not shown, by which the pressure roller 32 is pressed against the pressure pad 42 via the fixing belt 41. The pressurizing force of the pressure roller 32 to the pressure pad 42 during image forming operation is set to 1000 N, for example.

The guide portion 34 includes a support surface 34*a*, a positioning surface 34*b* serving as an example of a positioning portion, a sliding surface 34*c* and an opening portion 34*d*. The support surface 34*a* is formed on an opposing side of the pressure roller 32 along an attachment direction D1 for inserting the heating unit 40, and in a state where the heating unit 40 is positioned at the attachment position illustrated in FIG. 3, the fixing belt 41 supports a reaction force received from the pressure roller 32 at an inner circumference side of the fixing belt 41. The positioning surface 34*b* is formed approximately perpendicularly at a deepest portion in the attachment direction D1 of the guide portion 34, and in the state where the heating unit 40 is positioned at the attachment position, the heating unit 40 is positioned by abutting against the positioning surface 34*b* in the attachment direction D1. The sliding surface 34*c* is opposed to the support surface 34*a* and formed along the attachment direction D1 to guide the stay 45 by sliding movement when inserting or removing the heating unit 40. The opening portion 34*d* is an opening that communicates the inner and outer sides of the guide portion 34. By inserting the stay 45 through the opening portion 34*d* to the guide portion 34, the heating unit 40 can be moved to the attachment position, and by removing the stay 45 through the opening portion 34*d* to the outer side of the guide portion 34, the heating unit 40 can be removed from the casing 31. The guide portion 34 has a first guide portion 34*e* extended in the horizontal direction and a second guide portion 34*f* connected to the first guide portion 34*e* and extended diagonally upward in a direction opposite to the sheet conveyance direction X.

Figure 5:
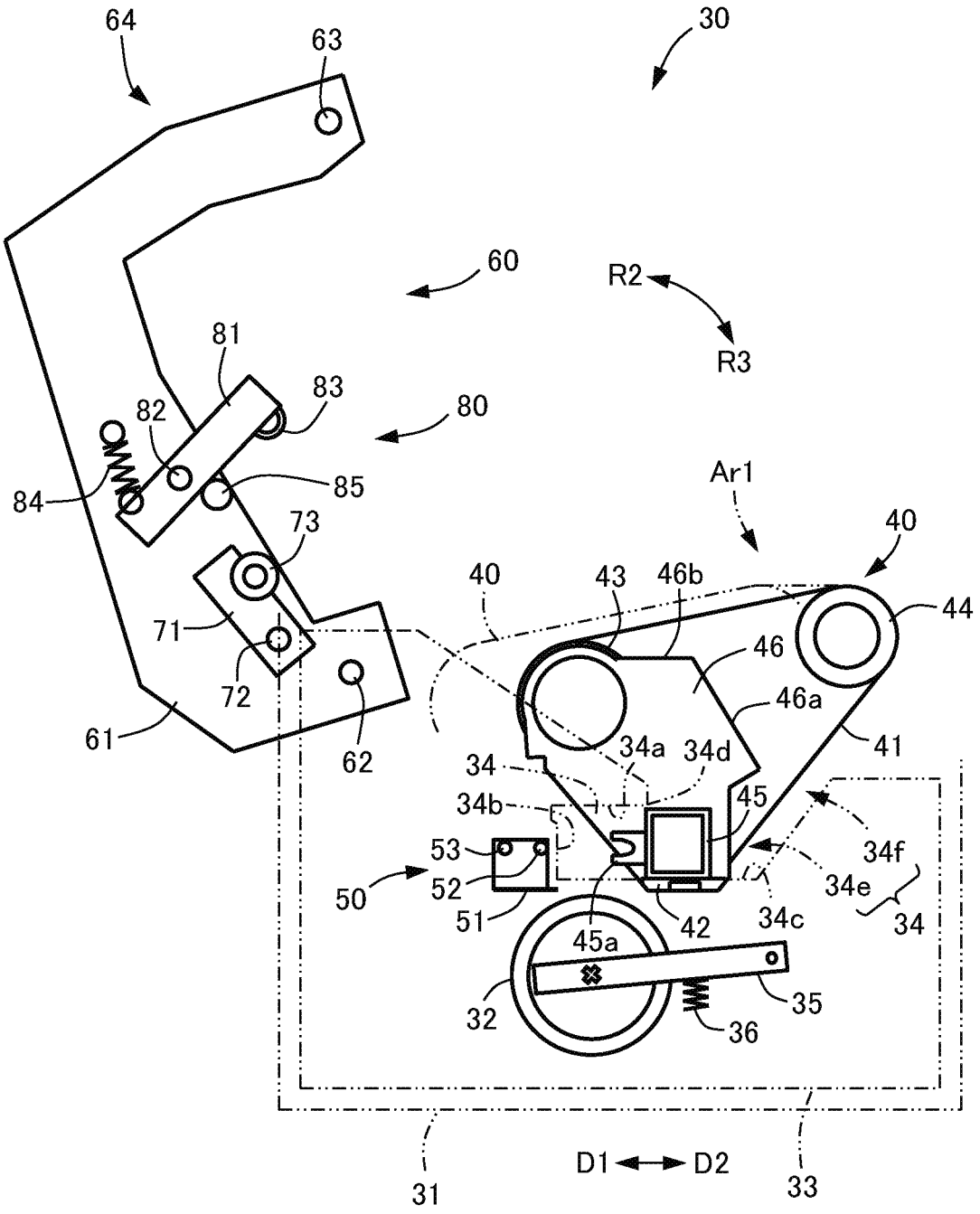
FIG. 5 is a cross-sectional view illustrating a state in which the heating unit is positioned at an insertion start position with the cover opened in the fixing unit according to the embodiment.

When attaching the heating unit 40 to the casing 31, the guide portion 34 guides and causes the heating unit 40 to be attached from an insertion start position (refer to FIG. 5) to an attachment position (refer to FIG. 3) so that the fixing belt 41 is positioned at the fixing nip portion N. The attachment position is a position where the stay 45 is abutted against the positioning surface 34*b* and the fixing belt 41 is positioned at the fixing nip portion N. In the present embodiment, the insertion start position is a position where an end portion in the attachment direction D1 of the stay 45 is inserted between the support surface 34*a* and the sliding surface 34*c*, where guiding by the guide portion 34 is started during insertion and guiding by the guide portion 34 is ended during removal, as illustrated in FIG. 5. Further, an area in which the heating unit 40 is movable between the insertion start position and the attachment position (illustrated by the imaginary line in FIG. 5) is referred to as a movable area Ar1.

In the present embodiment, the attachment direction D1 for inserting the heating unit 40 is a direction along the sheet conveyance direction of the recording material S nipped by the fixing nip portion N, which is set parallel in the illustrated example. However, the attachment direction D1 is not limited to being completely parallel with the sheet conveyance direction X at the fixing nip portion N, and it can be approximately parallel, or the attachment direction D1 and the sheet conveyance direction X can be set to opposite directions.

Further, in a state where the heating unit 40 is positioned at the attachment position as illustrated in FIG. 3, the position of the separation unit 50 with respect to the fixing belt 41 is determined by the guide shaft 52 of the separation unit 50 engaging with the separation plate positioning portion 45*a* of the stay 45. That is, the separation unit 50 retained in a swingable manner around the rotation shaft 53 is engaged by the guide shaft 52 being pressed against the engagement portion of the separation plate positioning portion 45*a*, by which the position of the separation unit 50 in a swinging direction is determined, and the positioning of the separation unit 50 and the fixing nip portion N is enabled.

The unit side plates 46 are provided on both sides in the rotational axis direction. Each unit side plate 46 includes a first abutment surface 46*a* and a second abutment surface 46*b*. The second abutment surface 46*b* is arranged along the attachment direction D1 and disposed continuously with the first abutment surface 46*a* but with a different angle value. The details of the first abutment surface 46*a* and the second abutment surface 46*b* will be described later.

Cover

Next, the cover 60 will be described in detail. The cover 60 is provided to cover the opening portion of the casing 31 and the heating unit 40 attached to the casing 31 to thereby protect and shield heat from the heating unit 40. The cover 60 includes a cover body 61, a cleaning unit 70 and the pressing portion 80.

The cover body 61 can cover the upper portion of the casing 31, both end portions in the rotational axis direction thereof, and both upstream and downstream side portions in the attachment direction D1 thereof. Both end portions in the rotational axis direction of the cover body 61 are axially supported pivotably on the fixing frame 33 through a swing shaft 62, which is an example of a rotation shaft. In the present embodiment, the swing shaft 62 is arranged downstream in the attachment direction D1 of the heating unit 40 positioned at the attachment position. That is, the cover body 61 is provided in a swingable manner with a swinging center regarding the casing 31 arranged downstream in the attachment direction D1 of the heating unit 40 positioned at the attachment position or the fixing nip portion N. The swing shaft 62 is not limited to being arranged downstream in the attachment direction D1 of the heating unit 40 positioned at the attachment position, and for example, even if the swing shaft 62 is not arranged downstream in the attachment direction D1 of the heating unit 40, the cover 60 should merely be openable in the attachment direction D1.

The cover body 61 includes an opening/closing engagement shaft 63 provided on both sides in the rotational axis direction on an outer diameter side of the swing shaft 62. The opening/closing engagement shaft 63 engages with the fixing frame 33 when the cover 60 is closed, by which the position of the cover 60 in the swinging direction with respect to the fixing frame 33 is determined.

Figure 4:
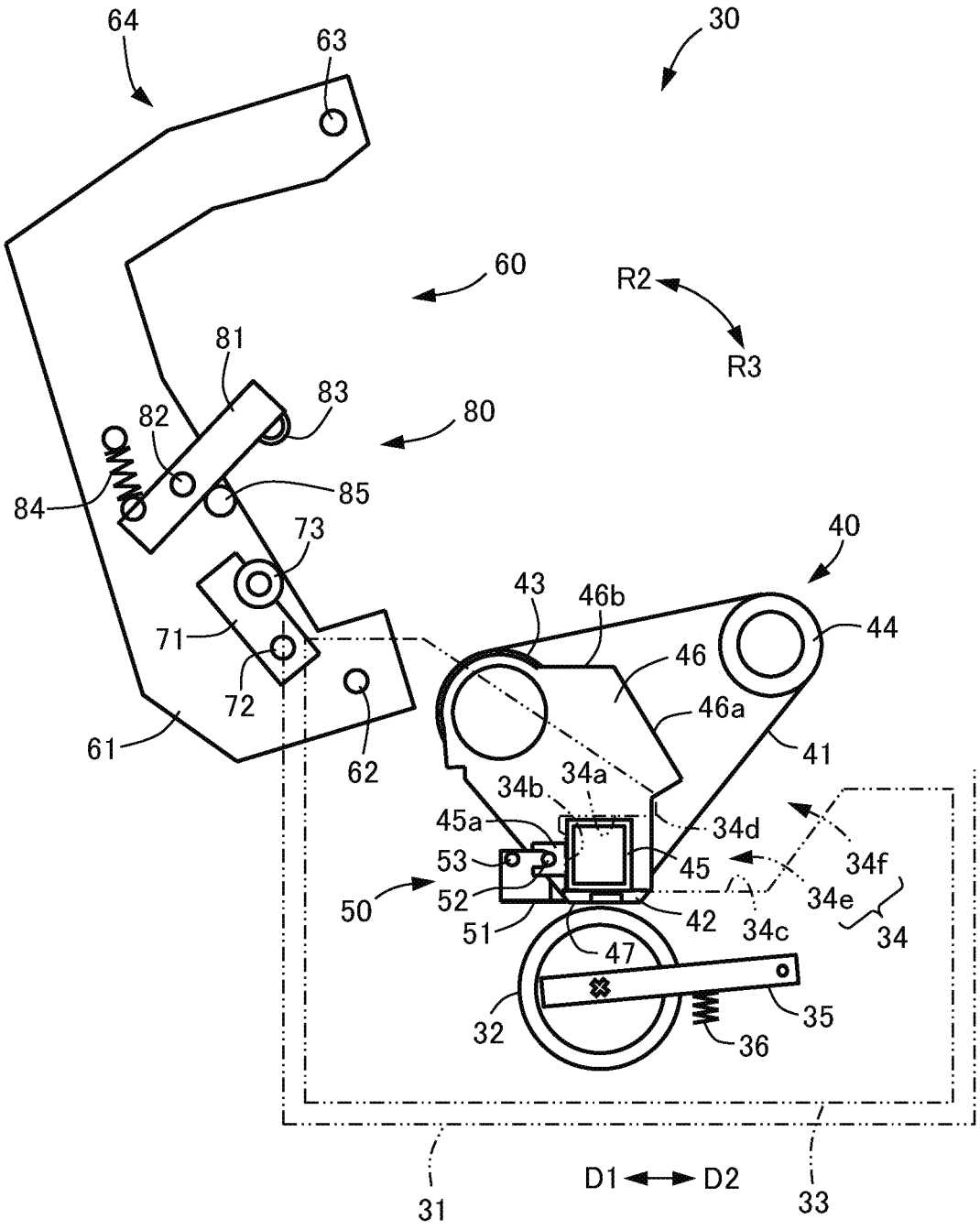
FIG. 4 is a cross-sectional view illustrating a state in which the heating unit is positioned at the attachment position with the cover opened in the fixing unit according to the embodiment.

The cover body 61 is movable by swinging motion between a first position and a second position. The first position is a position where the cover 60 covers the heating unit 40 positioned at the attachment position, as illustrated in FIG. 3. That is, the state in which the cover body 61 is positioned at the first position is a closed state where the guide portion 34 is closed. The second position is a position where the cover 60 has been retracted from the movable area Ar1 (refer to FIG. 5) of the heating unit 40 and the heating unit 40 is attachable to or removable from the casing 31, as illustrated in FIG. 4. In other words, the state in which the cover body 61 is positioned at the second position is an opened state where the guide portion 34 is opened.

The cover body 61 includes a shielding portion 64 positioned upstream in the attachment direction D1 of the heating unit 40 in the first position, as illustrated in FIG. 3. In the present embodiment, in a state where the cover body 61 is positioned at the first position, the shielding portion 64 extends in an up-down direction at an upstream in the attachment direction D1 of the heating unit 40 and positioned to overlap with the movable area Ar1 (refer to FIG. 5) of the heating unit 40. Therefore, the heating unit 40 positioned at the attachment position cannot be removed, or the heating unit 40 cannot be attached from the outer side. Further, the shielding portion 64 is moved to swing along with the swinging movement of the cover body 61 when the cover body 61 is positioned at the second position, as illustrated in FIG. 4, the position of the shielding portion 64 being downstream in the attachment direction D1 than its position in a state where the cover body 61 is positioned at the first position. Therefore, the heating unit 40 positioned at the attachment position can be removed easily or the heating unit 40 can be attached easily from the outer side without the interference of the cover 60. When the cover body 61 is positioned at the second position, the cover body 61 will be in contact with a stopper not shown provided on the casing 31 and cannot be opened further.

The cleaning unit 70 is an example of a contact portion, and it is provided to clean the surface of the fixing belt 41. The cleaning unit 70 is arranged to abut against the fixing belt 41 of the heating unit 40 positioned at the attachment position when positioned at the first position as illustrated in FIG. 3, and to be separated therefrom when positioned at the second position as illustrated in FIG. 4. The cleaning unit 70 includes an arm 71, a swing shaft 72, and a cleaning roller 73. The arm 71 is supported in a swingable manner by the swing shaft 72 with respect to the cover 60. The cleaning roller 73 is provided to remove foreign substances attached to a surface of the fixing belt 41. In the present embodiment, the cleaning roller 73 is, for example, a brush roller having an outer diameter of approximately 10 mm formed by winding a pile brush having fiber bundles embedded therein around a surface of a core metal formed of metal such as stainless steel or plated iron and having a diameter of 6 mm. A pressing unit not shown moves the cleaning roller axially supported on the arm 71 between the contact position and the separated position, and in the contact position, the cleaning roller 73 is caused to contact the fixing belt 41 by a power of approximately 20 N. In the present embodiment, the cleaning roller 73 abuts against the fixing belt 41 during image forming operation and is separated therefrom during non-image forming operation including maintenance operation.

The pressing portion 80 is provided to press the stay 45 of the heating unit 40 attached to the casing 31 against the positioning surface 34*b* and position the heating unit 40 at the attachment position. The pressing portion 80 is a lock mechanism that stabilizes the position of the heating unit 40 with respect to the fixing unit 30 by pressing the heating unit 40 against the fixing frame 33 in a state where the cover 60 is closed and positioned at the first position. The pressing portion 80 includes a pressing arm 81, a swing shaft 82, a pressing roller 83, a pressing spring 84, and a stopper 85.

The pressing arm 81 is axially supported in a swingable manner by the swing shaft 82 on both side portions in the rotational axis direction of the cover body 61. The pressing roller 83 is axially supported in a rotatable manner by the pressing arm 81. The pressing spring 84 is formed of a tension coil spring, for example, and the pressing roller 83 urges the pressing arm 81 toward the direction to press the heating unit 40. Further, as illustrated in FIG. 4, in a state where the pressing roller 83 is not in contact with the heating unit 40, the pressing arm 81 contacts the stopper 85 and regulates rotation of the pressing arm 81.

Removal Operation of Heating Unit

Next, an operation for removing the heating unit 40 from the fixing unit 30 according to the present embodiment will be described with reference to FIGS. 4 to 6. Normally, maintenance operation is carried out when the image forming process is not performed. Therefore, removal of the heating unit 40 is carried out in a state where the pressure roller 32 and the cleaning roller 73 are separated from the fixing belt 41 from the state illustrated in FIG. 3. As illustrated in FIG. 4, in a state where regulation by the opening/closing engagement shaft 63 is cancelled and the cover 60 is swung to a swinging direction R2 around the swing shaft 62, the cover 60 is moved to the second position. Thereby, the pressing portion 80 that had been pressing the heating unit 40 moves upward to the attachment direction D1, and the pressure applied to the heating unit 40 is cancelled. Thereby, the heating unit 40 can be removed toward a removal direction D2 that is opposite from the attachment direction D1.

When removing the heating unit 40 from the guide portion 34, the removal direction D2 is regulated by the sliding surface 34*c*, as illustrated in FIG. 5. In a state where the heating unit 40 is moved to the removal direction D2, the engagement between the separation plate positioning portion 45*a* and the guide shaft 52 is released. The heating unit 40 is moved to the removal direction D2 until the stay 45 exits through the opening portion 34*d* of the guide portion 34 formed on the fixing frame 33.

Figure 6:
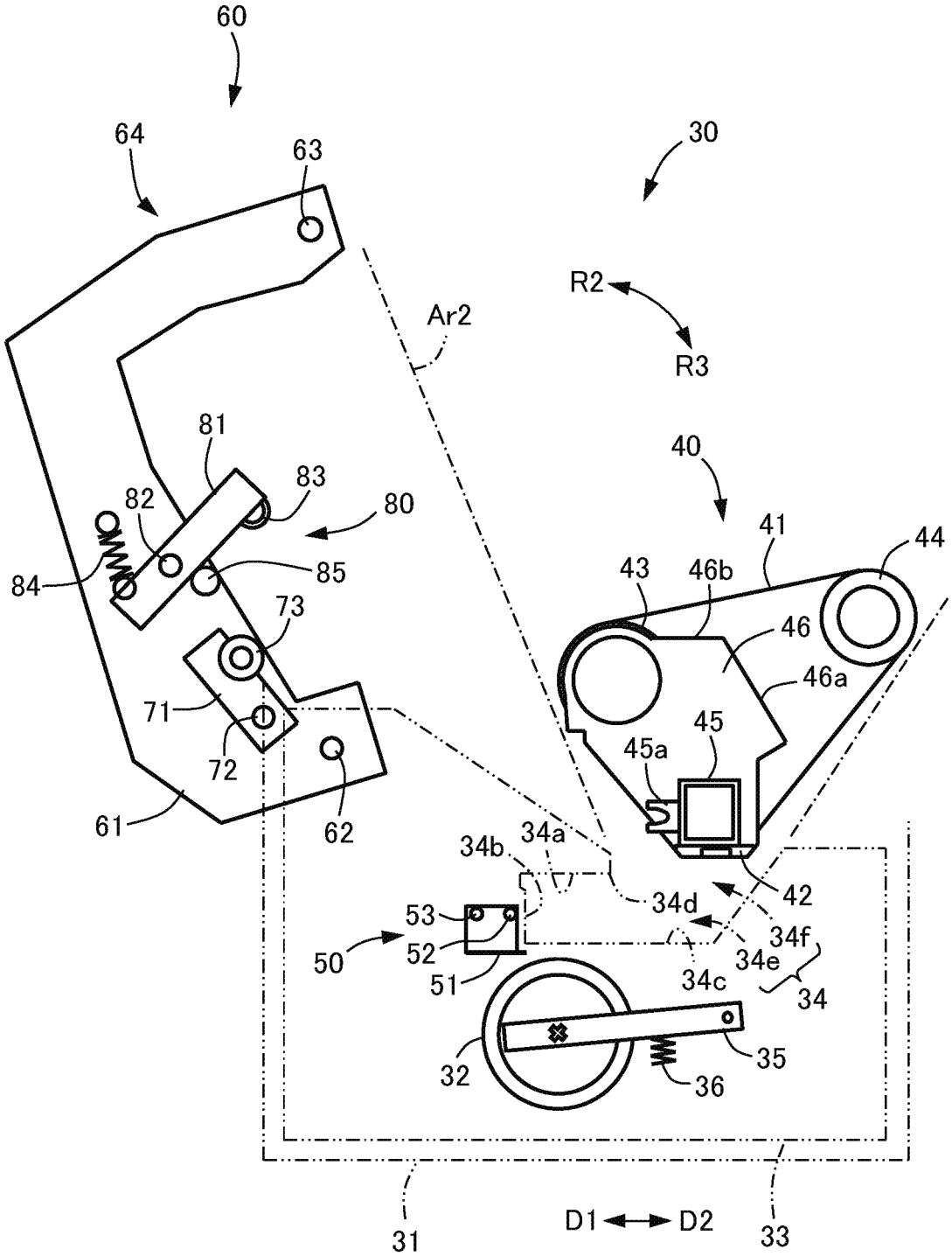
FIG. 6 is a cross-sectional view illustrating a state in which the heating unit is positioned at an outer portion of the opening portion with the cover opened in the fixing unit according to the embodiment.

When the stay 45 exits through the opening portion 34*d* to the exterior, the heating unit 40 can be removed from the fixing unit 30, as illustrated in FIG. 6. In a state where the heating unit 40 is removed from the fixing unit 30, the separation plate 51 and the pressure roller 32 remain in the fixing unit 30. The cover 60 is positioned at the second position where the cover is retracted to an opposite direction as the removal direction D2 in which the heating unit 40 is removed, and the entire body of the cover 60 is retracted from a work area Ar2 (area shown between long and short dashed lines) for attaching and detaching the heating unit 40. Therefore, during the removal operation and the attaching operation of the heating unit 40, the cover 60 will not interfere with the line of movement of the heating unit 40 and will not hinder the operation.

Therefore, the operator will not have to take an unreasonable posture of working with the cover 60 placed therebetween and can work in a natural posture, so that deterioration of workability due to the presence of the cover 60 or occurrence of excessive operation of removing the cover 60 can be prevented. In a state where the cover 60 is positioned at the second position, the cleaning roller 73 is separated from the fixing belt 41 and moved to a retracted position in the removal direction D2 of the heating unit 40. Thereby, during the removal operation and the attaching operation of the heating unit 40, the risk of the cleaning roller 73 being in contact with the fixing belt 41 and damaging the fixing belt 41 can be suppressed.

Attaching Operation of Heating Unit

Next, the operation for attaching the heating unit 40 to the fixing unit 30 according to the present embodiment will be described with reference to FIGS. 6, 5, 4, 7, and 8 in the named order. As illustrated in FIG. 6, when attaching the heating unit 40, the stay 45 is inserted to the opening portion 34*d* of the guide portion 34 and the stay 45 is placed on the sliding surface 34*c*, as illustrated in FIG. 5. Then, the heating unit 40 swings to the attachment direction D1, and the stay 45 is abutted against the positioning surface 34*b*, as illustrated in FIG. 4. In this state, the guide shaft 52 of the separation unit 50 is engaged with the separation plate positioning portion 45*a*, and the relative positions of the heating unit 40 and the separation plate 51 are determined.

Figure 7:
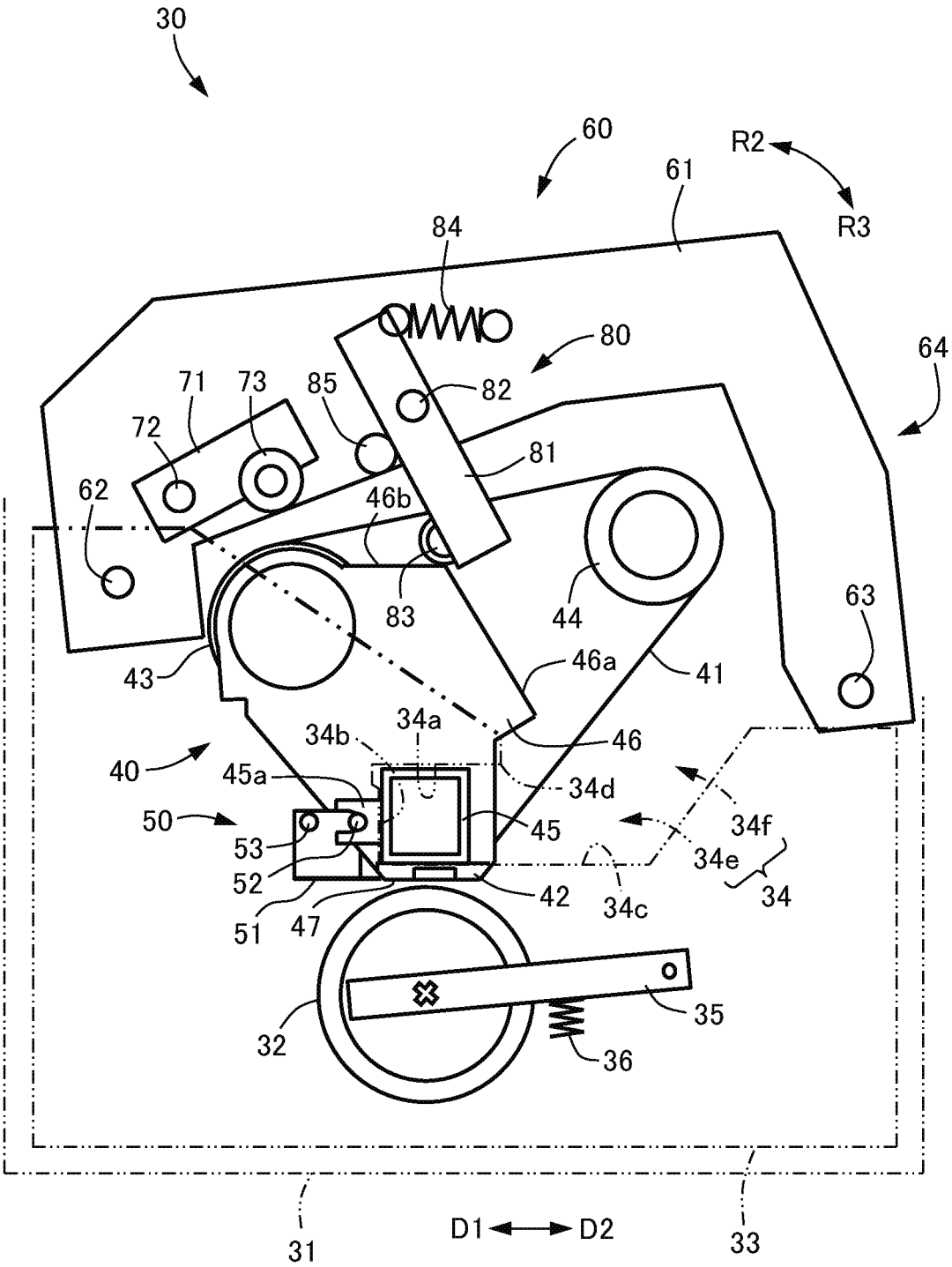
FIG. 7 is a cross-sectional view illustrating a state in which the heating unit is positioned at the attachment position with the cover not closed in the fixing unit according to the embodiment.

As illustrated in FIG. 7, in a state where the cover 60 is swung to a swinging direction R3, the pressing arm 81 is moved in a state abutted against the stopper 85, and the pressing roller 83 abuts against the second abutment surface 46*b* formed on the heating unit 40. In a state where the cover 60 swings further to the swinging direction R3 with the pressing roller 83 abutted against the second abutment surface 46*b*, the pressing arm 81 swings in the swinging direction R2 around the swing shaft 82 via the pressing roller 83 and separates from the stopper 85 against the pressing spring 84. Thereby, the pressing force by the pressing spring 84 is caused to act on the heating unit 40. That is, in a state where the heating unit 40 is positioned at the attachment position and the cover 60 is moved from the second position to the first position, the pressing roller 83 abuts against the second abutment surface 46*b* before abutting against the first abutment surface 46*a*.

Figure 8:
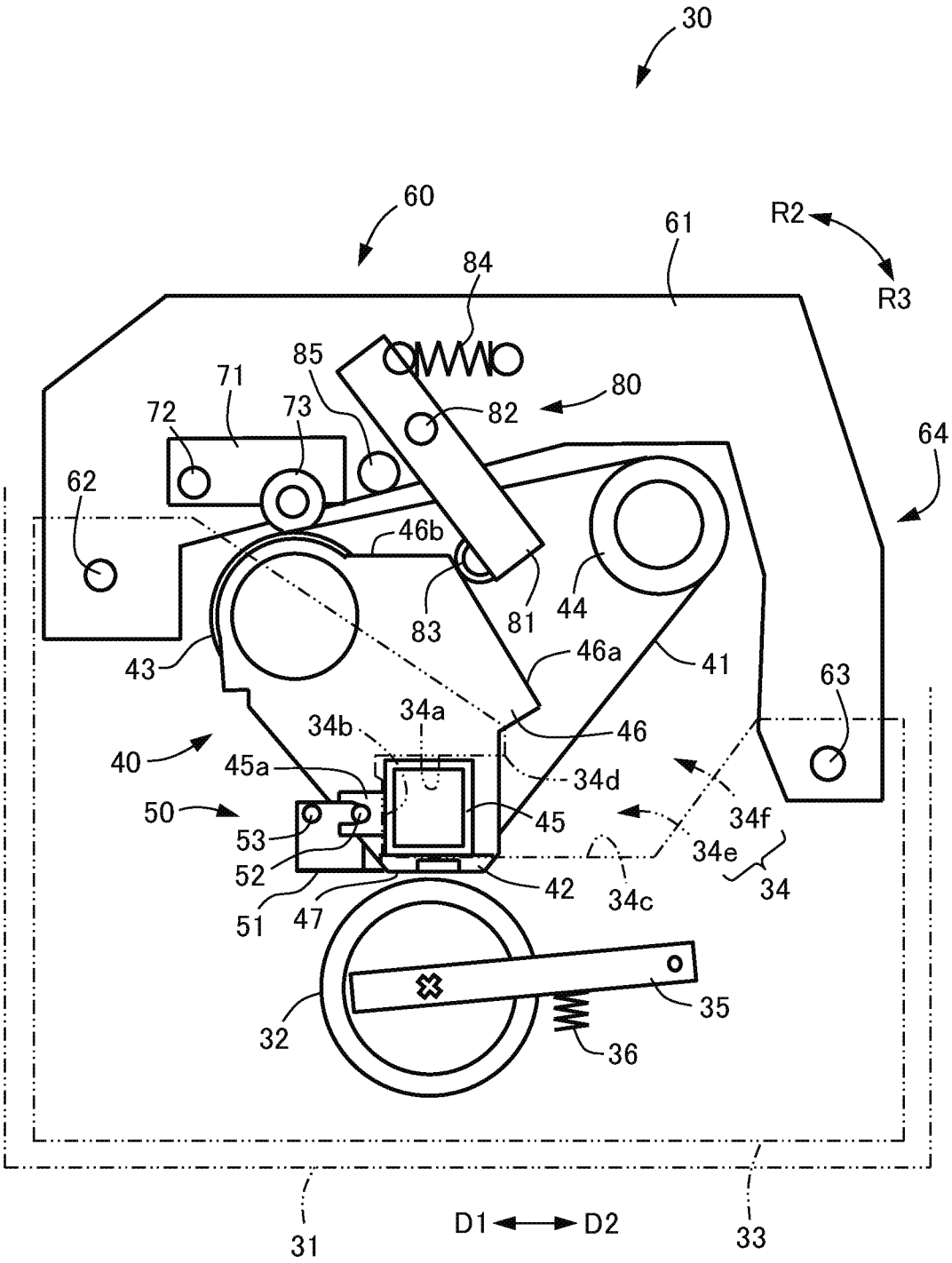
FIG. 8 is a cross-sectional view illustrating a state in which the heating unit is positioned at the attachment position with the cover closed and the fixing nip portion not formed in the fixing unit according to the embodiment.

As illustrated in FIG. 8, in a state where the cover 60 is closed and positioned at the first position, the pressing roller 83 presses the first abutment surface 46*a* of the heating unit 40 by the pressing spring 84. That is, in a state where the heating unit 40 is positioned at the attachment position and the cover 60 is positioned at the first position, the pressing roller 83 abuts against the first abutment surface 46*a*. In this state, pressing force is divided according to an angle formed by the inclination angle of the first abutment surface 46*a* and the pressing direction of the pressing roller 83, and a pressing force is applied in the attachment direction D1 pressing the heating unit 40 against the fixing frame 33. Thereby, the pressing portion 80 abuts against the heating unit 40 positioned at the attachment position when the cover 60 is positioned at the first position to press the heating unit 40 downstream in the attachment direction D1 and position the heating unit 40 against the positioning surface 34*b*.

The angle formed by the first abutment surface 46*a* with the attachment direction D1 should be close to 90 degrees to press the heating unit 40 effectively against the fixing frame 33. Therefore, the first abutment surface 46*a* preferably forms an angle of 45 degrees or greater and 90 degrees or smaller with the attachment direction D1.

The second abutment surface 46*b* and the first abutment surface 46*a* have different inclination angles but are arranged continuously. Thus, the pressing roller 83 can contact the second abutment surface 46*b* and apply rotational force by the pressing spring 84 while moving to the first abutment surface 46*a*, so that the pressing portion 80 can press the heating unit 40 after coming into contact therewith. If the heating unit 40 is merely attached to place by the user, there may be a gap between the stay 45 of the heating unit 40 and the positioning surface 34*b* of the guide portion 34. In contrast, by having the pressing roller 83 contact the first abutment surface 46*a*, a force pressing the stay 45 against the positioning surface 34*b* can be generated, and the position and posture of the heating unit 40 can be set preferably.

As described, according to the fixing unit 30 of the present embodiment, in a state where the cover 60 is opened and positioned at the second position, the cover 60 is positioned downstream in the attachment direction D1 than when the cover 60 is closed and positioned at the first position. Therefore, by positioning the cover 60 at the second position that is retracted to the opposite direction as the removal direction D2 for removing the heating unit 40, the entire body of the cover 60 can be retracted from the work area Ar2 (refer to FIG. 6) for attaching and detaching the heating unit 40. Thereby, during the attaching and detaching operation of the heating unit 40, the cover 60 will not be overlapped with the line of movement of the heating unit 40, so that the hinderance of operation can be suppressed and the workability can be improved. According to the present embodiment, a pivoting angle from the first position where the cover body 61 is closed to a position where the cover body 61 is abutted against a stopper not shown provided on the fixing unit 30 and opened should preferably be 90 degrees or greater and 135 degrees or smaller.

According to the fixing unit 30 of the present embodiment, the cover 60 includes the pressing portion 80. Therefore, when attaching the heating unit 40, the heating unit 40 can be pressed toward the attachment direction D1 by simply closing the cover 60, and the heating unit 40 can be accurately positioned and attached to the fixing unit 30.

Further according to the fixing unit 30 of the present embodiment, the cover 60 includes the cleaning unit 70. Therefore, when attaching and detaching the heating unit 40, members and mechanisms that contact the surface of the fixing belt 41 can be retracted, and the attaching and detaching of the heating unit 40 can be facilitated.

According further to the fixing unit 30 of the present embodiment, the second abutment surface 46*b* and the first abutment surface 46*a* are arranged continuously with different inclination angles. Therefore, the contact and pressing operations of the pressing roller 83 to the heating unit 40 can be performed continuously, and the heating unit 40 can be positioned smoothly to the attachment position.

The fixing unit 30 of the present embodiment described above has been illustrated of a case where both the heating roller 43 and the pressure roller 32 are driven by driving the drive motor M1, but the present technique is not limited thereto. For example, it is possible to have the pressure roller 32 driven by the drive motor M1 and the fixing belt 41 rotated following the rotation of the pressure roller 32. In that case, the heating unit 40 is pressed toward the sheet conveyance direction X, so that it is advantageous from the point of view of force to attach the heating unit 40 in the sheet conveyance direction X. According to the fixing unit 30 of the present embodiment, the attachment direction D1 of the heating unit 40 is set to a direction parallel to the sheet conveyance direction X of the recording material S nipped by the fixing nip portion N, so that it is also preferable in the case mentioned above.

Further, the fixing unit 30 of the present embodiment described above has been illustrated of a case where the cleaning unit 70 and the pressing portion 80 are provided to the cover 60, but the present technique is not limited thereto, and these members can be omitted. According further to the fixing unit 30 of the present embodiment described above, the cover 60 has been opened and closed by swinging motion, but the present technique is not limited thereto. For example, the cover 60 can be opened and closed by sliding motion.

Even further, the fixing unit 30 of the present embodiment described above has been illustrated using a belt as the first rotary member, but the present technique is not limited thereto, and for example, the first rotary member can be a roller. Moreover, the heating roller 43 can be omitted, and the heating source for heating the heating unit 40 can adopt a configuration of heating the first rotary member from an outer side of the heating unit 40.

Furthermore, the fixing unit 30 of the present embodiment described above has adopted a configuration where the heating unit 40 is attached to and detached from the fixing unit 30 independently from the pressing roller 32, but the present technique is not limited thereto, and a configuration can be adopted where the heating unit 40 and the pressure roller 32 are integrally attached to and detached from the fixing unit 30.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-083700, filed May 12, 2020 which is hereby incorporated by reference herein in its entirety.

What is claimed is:

1. An image heating apparatus comprising:

a heating unit including a first rotary member, the heating unit being configured to heat a toner image formed on a recording material;

a second rotary member configured to contact the first rotary member and form a fixing nip portion with the first rotary member for conveying the recording material;

a frame member configured to support the heating unit and the second rotary member;

a separation plate supported on the frame member and arranged so as not to contact the first rotary member, the separation plate being configured to separate the recording material from the first rotary member;

a guide portion configured to guide the heating unit to be moved upstream in a conveyance direction of the recording material when the heating unit is being removed; and a cover attached to the frame member and configured to turn around a rotation shaft to open and close the guide portion, wherein the cover is configured to turn in a direction toward the conveyance direction to open the guide portion.

2. The image heating apparatus according to claim 1, wherein the heating unit is configured to be removable from the image heating apparatus in a state where the second rotary member is supported on the frame member.

3. The image heating apparatus according to claim 1, wherein the guide portion comprises a first guide portion extended in a horizontal direction and a second guide portion connected to the first guide portion and extended diagonally upward in a direction opposite to the conveyance direction.

4. The image heating apparatus according to claim 1, wherein the rotation shaft is arranged downstream of the fixing nip portion in the conveyance direction.

5. The image heating apparatus according to claim 1, wherein the guide portion comprises a positioning portion configured to position the heating unit to an attachment position by abutment, and the cover comprises a pressing portion configured to abut against the heating unit positioned at the attachment position and press the heating unit downstream in an attachment direction to position the heating unit at the positioning portion in a state where the cover is at a closed position.

6. The image heating apparatus according to claim 5, wherein the heating unit comprises a first abutment surface against which the pressing portion abuts in a state where the heating unit is positioned at the attachment position and the cover is positioned at the closed position, and in a state where the heating unit is positioned at the attachment position, the first abutment surface forms an angle of 45 degrees or greater and 90 degrees or smaller with the attachment direction.

7. The image heating apparatus according to claim 6, wherein the heating unit comprises a second abutment surface against which the pressing portion abuts before abutting against the first abutment surface in a state where the heating unit is positioned at the attachment position and the cover is moved from an opened state to the closed position, and the second abutment surface is arranged along the attachment direction and formed continuously with the first abutment surface.

8. The image heating apparatus according to claim 1, wherein the cover comprises a contact portion configured to abut against the first rotary member in a state where the heating unit is attached.

9. The image heating apparatus according to claim 1, wherein a turning angle of the cover from a position in which the cover closes the guide portion to a position in which the cover opens the guide portion is 90 degrees or greater and 135 degrees or smaller.

10. The image heating apparatus according to claim 1, wherein the first rotary member is a belt member.

11. The image heating apparatus according to claim 10, wherein the belt member is stretched across a plurality of rollers.

12. The image heating apparatus according to claim 10, wherein a heating unit comprises a pad configured to press the second rotary member via the belt member.

13. An image forming apparatus configured to form an image on a recording material, comprising:

the image heating apparatus according to claim 1; and a drawer portion configured to support the image heating apparatus and be drawn out from the image forming apparatus.

14. An image heating apparatus comprising:

a heating unit including a first rotary member, the heating unit being configured to heat a toner image formed on a recording material;

a second rotary member configured to contact the first rotary member and form a fixing nip portion with the first rotary member for conveying the recording material;

a frame member configured to support the heating unit and the second rotary member;

a separation plate supported on the frame member and arranged so as not to contact the first rotary member, the separation plate being arranged downstream of the fixing nip portion in a conveyance direction of the recording material and being configured to separate the recording material from the first rotary member;

a cover having a swing shaft and a free end, the swing shaft being arranged downstream of the fixing nip portion in the conveyance direction and above the fixing nip portion in a vertical direction, the cover being movable between a first position and a second position, the first position being a position where the cover covers the heating unit attached to the frame member, the second position being a position where the cover opens the heating unit; and a guide portion configured to guide the heating unit to be moved upstream in the conveyance direction when the cover is in the second position and the heating unit is being removed, wherein in a state where the cover is in the first position, the free end of the cover is arranged upstream of the heating unit in the conveyance direction and below the swing shaft in the vertical direction, wherein in a state where the cover is in the second position, the free end of the cover is arranged above the swing shaft in the vertical direction.

* * * * *